US012782040B2

(12) United States Patent
Karabas et al.

(10) Patent No.: US 12,782,040 B2
(45) Date of Patent: Nov. 3, 2026

(54) HOUSEHOLD REFRIGERATION APPLIANCE HAVING A DRAWER-TYPE DOOR WITH A LIGHT UNIT

(71) Applicant: BSH Hausgeräte GmbH, Munich (DE)

(72) Inventors: Altug Karabas, Ulm (DE); Oguz Kaan Gür, Neu-Ulm (DE); Ashish Modi, Istanbul (TR)

(73) Assignee: BSH Hausgeräte GmbH, Munich (DE)

( * ) Notice: Subject to any disclaimer, the term of this patent is extended or adjusted under 35 U.S.C. 154(b) by 112 days.

(21) Appl. No.: 18/843,070

(22) PCT Filed: Mar. 10, 2023

(86) PCT No.: PCT/EP2023/056121
§ 371 (c)(1),
(2) Date: Aug. 30, 2024

(87) PCT Pub. No.: WO2023/180091
PCT Pub. Date: Sep. 28, 2023

(65) Prior Publication Data

US 2025/0164181 A1 May 22, 2025

(30) Foreign Application Priority Data

Mar. 25, 2022 (TR) ..... 2022/004580

(51) Int. Cl.
*F25D 25/02* (2006.01)

(52) U.S. Cl.
CPC ..... *F25D 25/02* (2013.01)

(58) Field of Classification Search
CPC ..... F25D 25/025; F25D 27/00; F25D 23/028; F25D 2327/001; F25D 2700/02
See application file for complete search history.

(56) References Cited

U.S. PATENT DOCUMENTS 9,456,704 B2 * 10/2016 Bhargava ..... A47F 3/001
11,112,162 B2 * 9/2021 Hiller ..... F25D 17/005
2006/0077653 A1 * 4/2006 Nowak ..... F21V 17/164 362/133

(Continued)

FOREIGN PATENT DOCUMENTS

CN 101858682 A 10/2010
CN 104279809 A 1/2015

(Continued)

*Primary Examiner* — Daniel J Rohrhoff
(74) *Attorney, Agent, or Firm* — Laurence A. Greenberg; Werner H. Stemer; Ralph E. Locher

(57) ABSTRACT

A household refrigeration appliance with a main body has a first and a second storage chamber for storing foodstuffs. First and second drawer-type doors enable access to the storage chambers. A light unit is provided at a lower wall of the upper drawer door, facing the second storage chamber so as to direct light towards the second storage chamber when the second drawer door is in an open position and the second storage chamber is accessible from outside. The light unit includes a light module on an outward surface and a reinforcement part on an inward surface of the lower wall of the upper drawer door. The light module and the reinforcement part are provided at a connection region of the lower wall where a connection opening for one or more connection cables of the light unit is formed.

15 Claims, 11 Drawing Sheets

(56) References Cited

U.S. PATENT DOCUMENTS

| | | | | |
|---|---|---|---|---|
| 2010/0220460 | A1* | 9/2010 | Hall | F25D 27/00 362/92 |
| 2010/0320890 | A1* | 12/2010 | Jung | F25D 27/00 312/405 |
| 2016/0061429 | A1* | 3/2016 | Waalkes | F21V 23/001 439/639 |
| 2016/0313051 | A1* | 10/2016 | Alt | F21V 33/0012 |
| 2019/0339003 | A1* | 11/2019 | Signorino | F25D 27/00 |
| 2023/0152034 | A1* | 5/2023 | Mi | F25D 25/025 312/405 |
| 2024/0337435 | A1* | 10/2024 | Hwang | F21V 23/001 |

FOREIGN PATENT DOCUMENTS

| | | | |
|---|---|---|---|
| DE | 102013224260 | A1 | 5/2015 |
| EP | 1580851 | A1 | 9/2005 |
| EP | 2267386 | A2 | 12/2010 |
| ES | 2343293 | A1 | 7/2010 |
| JP | H10300338 | A | 11/1998 |
| WO | 2018068424 | A1 | 4/2018 |

* cited by examiner

HOUSEHOLD REFRIGERATION APPLIANCE HAVING A DRAWER-TYPE DOOR WITH A LIGHT UNIT

TECHNICAL FIELD

The present invention relates to a household refrigeration appliance with a main body, having a first storage chamber for storing foodstuffs, a second storage chamber for storing foodstuffs, provided under the first storage chamber, at least one first drawer door configured to open or close the first storage chamber, at least one second drawer door configured to open or close the second storage chamber, and a light unit provided at a lower wall of the first drawer door facing the second storage chamber so as to direct a light towards the second storage chamber when the second drawer door is in an open position in and the second storage chamber is accessible from outside.

STATE OF THE ART

Household refrigeration appliances, particularly refrigerators, has a main body comprising a first storage chamber for storing foodstuffs, and a second storage chamber for also storing foodstuffs, provided under the first storage chamber. At least one first drawer-type door is configured to open or close the first storage chamber. Moreover, at least one second drawer-type door is configured to open or close the second storage chamber. Light units are provided at a lower side of the first drawer-type door facing the second storage chamber so as to direct the light beams towards the second storage chamber for illuminating inside the second storage chamber. This allows the user to easily see the foodstuffs inside the second storage chamber, when it is in an open position. During the lifecycle of such light units, mounting and demounting of the light units are not as easy as desired. So servicing operation of the light units may become difficult.

The state of the art document numbered EP2267386 A2 discloses a refrigerator including a main body provided with a first storage compartment and a second storage compartment, vertically divided from each other. A first storage compartment door and a second storage compartment door are vertically disposed so as to open and close the first storage compartment and the second storage compartment of the main body. An illumination unit is provided at at least one of the lower end portion of the first storage compartment door and the upper portion of the second storage compartment. Also an input unit is provided to input operation data of the illumination unit.

The invention provides an additional improvement, an additional advantage or an alternative to the prior art.

BRIEF SUMMARY OF THE INVENTION

The object of the invention is to provide a household refrigeration appliance with a foamed drawer-type door having a light unit having a light module which is easy to assemble or disassemble.

In order to achieve the above-mentioned objects, the invention is a household refrigeration appliance with a main body, comprising: a first storage chamber for storing foodstuffs, a second storage chamber for storing foodstuffs, provided under the first storage chamber, at least one first drawer-type door configured to open or close the first storage chamber, at least one second drawer-type door configured to open or close the second storage chamber, and a light unit provided at a lower wall of the first drawer-type door facing the second storage chamber so as to direct the light beams towards the second storage chamber, when the second drawer-type door is in an open position in which the second storage chamber is accessible from outside. In the invention, the light unit comprises a light module provided on a first surface of the lower wall facing outside, and a reinforcement part provided on a second surface of the lower wall facing inside of the first drawer-type door, and in that both the light module and the reinforcement part are provided at a connection region of the lower wall where a connection opening through which one or more connection cables of the light unit pass, is provided. Thus, the light module can be assembled to the lower wall of the foamed first drawer-type door from outside easily. Similarly, the light module can be disassembled from the lower wall of the first drawer-type door from outside easily.

Here, the lower wall of the first drawer-type door can be made from a sheet metal.

Here, the first storage chamber and second storage chamber are being a container, such as a drawer which is movable between the open position and the closed position.

Here, the light module can directly be mounted to the lower wall with at least one connection members and/or adhesive members.

Here, the light module can be mounted to both of the reinforcement part and the lower wall with at least one connection members.

Here, the drawer-type door means a door that is movable together with a container, such as a drawer.

In a possible embodiment of the invention, the connection region is provided at a middle portion of the lower wall extending along a width direction of the first drawer-type door. Thus, the light unit directs the light beams towards the second storage chamber from the most suitable proportional location.

In a possible embodiment of the invention, the light module comprises a module housing and a circuit board configured with a light source, provided on the module housing. Thus, the light unit generates the light beams for illuminating inside the second storage chamber.

Here, the light source can be any kind of illuminating member such as a light emitting diode (LED).

In a possible embodiment of the invention, a first side of the module housing facing the lower wall, is configured as a receiving groove for receiving the circuit board configured with the light source. Thus, the circuit board provided with the light source is embodied inside the module housing which is outside the foamed first drawer-type door.

In a possible embodiment of the invention, a base opening is provided on the module housing corresponding to a diffusing member which diffuses the light beams generated by the light source towards the second storage chamber in the open position. Thus, the light beams are diffused to a wider area of inside of the second storage chamber.

In a possible embodiment of the invention, the circuit board comprises one or more first connection holes, and one or more first connection protrusions are provided on the module housing, corresponding to the first connection holes. Thus, the horizontal movements, i.e. left-right movements of the circuit board provided with the light source are prevented.

Here the first connection protrusions are shaped and sized according the first connection holes. The first connection protrusions can be in any shape, i.e. in a cylindrical shape. Similarly, the first connection holes can be in any shape, i.e. in a circular shape.

In a possible embodiment of the invention, the diffusing member comprises one or more second connection protrusions, one or more second connection holes are provided on the circuit board, and each of the second connection protrusions pass through the respective second connection holes, when the circuit board seat onto the diffusing member. Thus, the horizontal movements, i.e. left-right movements and front-rear movements of the circuit board provided with the light source is prevented.

In a possible embodiment of the invention, a free end of the first connection protrusions has a widening section formed after the circuit board and the diffusing member located on the module housing in such a way that the connection protrusions pass through the respective first connection holes, and provided so as to limit a vertical movement of the circuit board and the diffusing member. Thus, the vertical movements of the circuit board provided with the light source are prevented. Furthermore, the vertical movements of the diffusing member is also prevented by sandwiching the diffusing member between a base wall of the module housing and the circuit board.

In a possible embodiment of the invention, the light module and the reinforcement part are configured so as to connect each other with one or more connection element from outside of the first drawer-type door. Thus, the light module can be mounted to the first drawer-type door from outside easily, and also similarly the light module can be demounted from the first drawer-type door easily.

In a possible embodiment of the invention, the module housing has one or more hollow connection protrusions through which the connection element passes, and wherein the reinforcement part has one or more hollow module connection protrusions in which the respective connection element attaches, corresponding to the hollow module connection protrusions. Thus, the light module connects to the lower wall of the first drawer-type door. Moreover, the connection elements can not be seen from outside and thus the aesthetic appearance of the device is not adversely affected.

In a possible embodiment of the invention, the reinforcement part is configured as a hollow-shaped box through which the connection cables of the light unit passes. Thus, during the foaming process of the first drawer-type door, the connection cables are being inside the reinforcement part not to adversely effected from the foaming process.

In a possible embodiment of the invention, the reinforcement part comprises an entrance opening where the connection cables of the light unit enters to the reinforcement part configured as a hollow-shaped box. Thus, connection cables enter the reinforcement part.

In a possible embodiment of the invention, an adhesive member is provided on at least one of the regions provided between the reinforcement part and the second surface, or between the light module and the first surface. Thus, the connection at least one of the regions provided between the module housing and the reinforcement part, or between the module housing and the light module, are strengthened.

Here, the adhesive member can be any kind of element that helps to bond the reinforcement part to the lower wall, such as a double-sided tape.

In a possible embodiment of the invention, two first drawer-type doors are provided for opening and closing the first storage chamber, and wherein each of the first drawer-type doors have light units independent from each other for directing the light beams towards the respective second storage chambers. Thus, each of the drawer-type doors are provided with the advantageous light unit.

In a possible embodiment of the invention, a first sensing unit is provided on a portion of the second drawer-type door, a second sensing unit is provided on the main body, and the sensing units are configured to detect a position of the second drawer-type door provided with the second storage chamber in order to activate or deactivate the light unit with regards to the position of the second storage chamber. Thus, the light unit illuminates the second storage chamber when only the second storage chamber is opened.

Here, the sensing units can be any kind of sensors, i.e. a magnetic sensors.

In this context, with the indications "top", "bottom", "front", "rear", "horizontal", "vertical", "upward", "downward", "inner", "outer", "inward", "outward" etc. the positions and orientations given for intended use and intended arrangement of the household refrigeration appliance and for a user then standing in front of the household refrigeration appliance in a closed position and viewing in the direction of the appliance are indicated.

Each possible embodiment disclosed in this text can be combined with the other possible embodiments disclosed in this text if there is no any technical constraint.

BRIEF DESCRIPTION OF THE FIGURES

The figures, whose brief explanations are herewith provided, are solely intended for providing a better understanding of the present invention and are as such not intended to define the scope of protection or the context in which said scope is to be interpreted in the absence of the description.

DETAILED DESCRIPTION OF THE FIGURES

In this detailed description, the subject matter is explained with references to examples without forming any restrictive effect only in order to make the subject more understandable.

Figure 1:
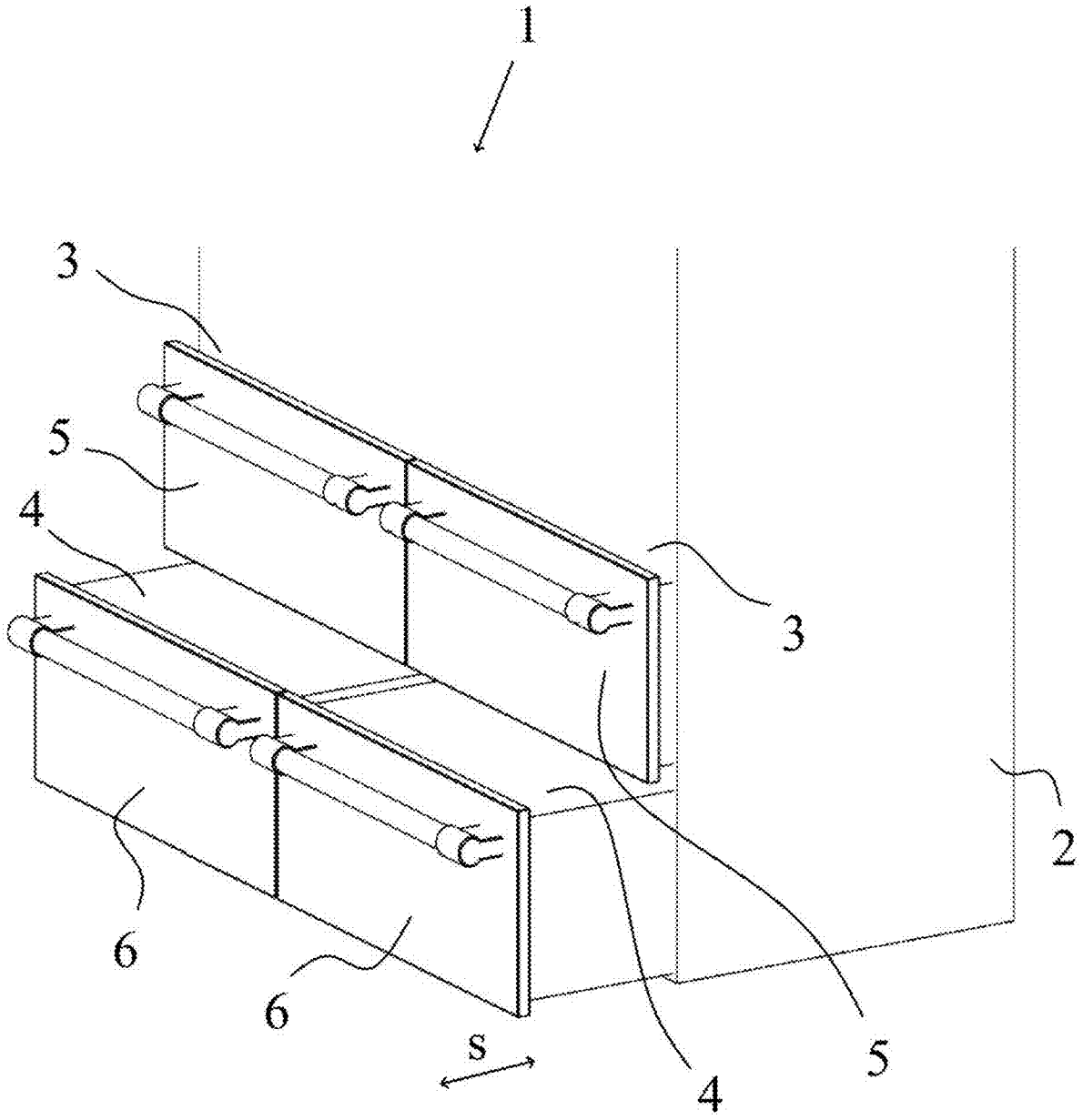
FIG. 1 is a zoomed perspective isometric view of the household refrigeration appliance where the first and second storage chambers can be seen.
Figure 2:
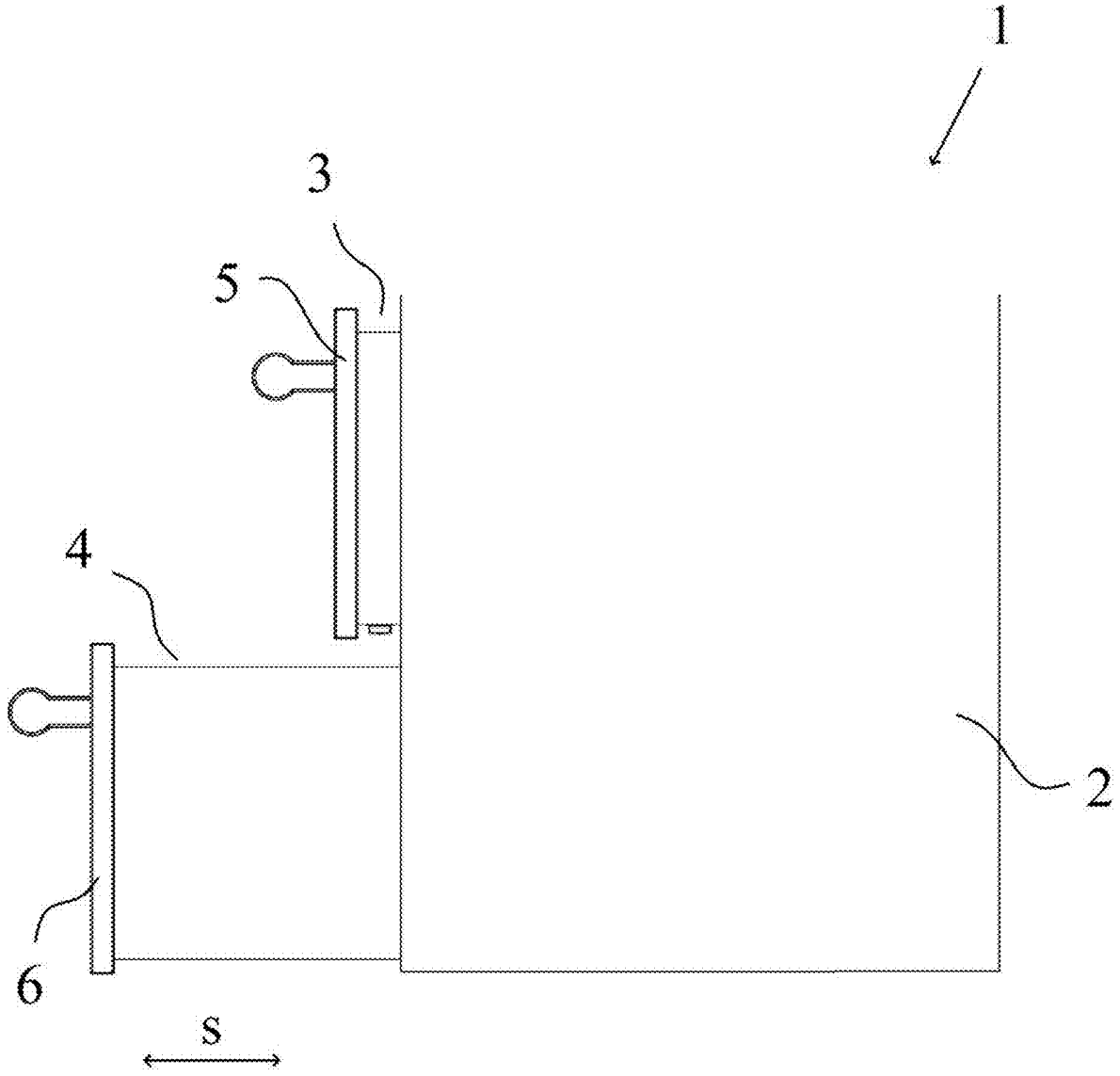
FIG. 2 is a side view of the household refrigeration appliance where the first and second storage chambers can be seen.
Figure 3:
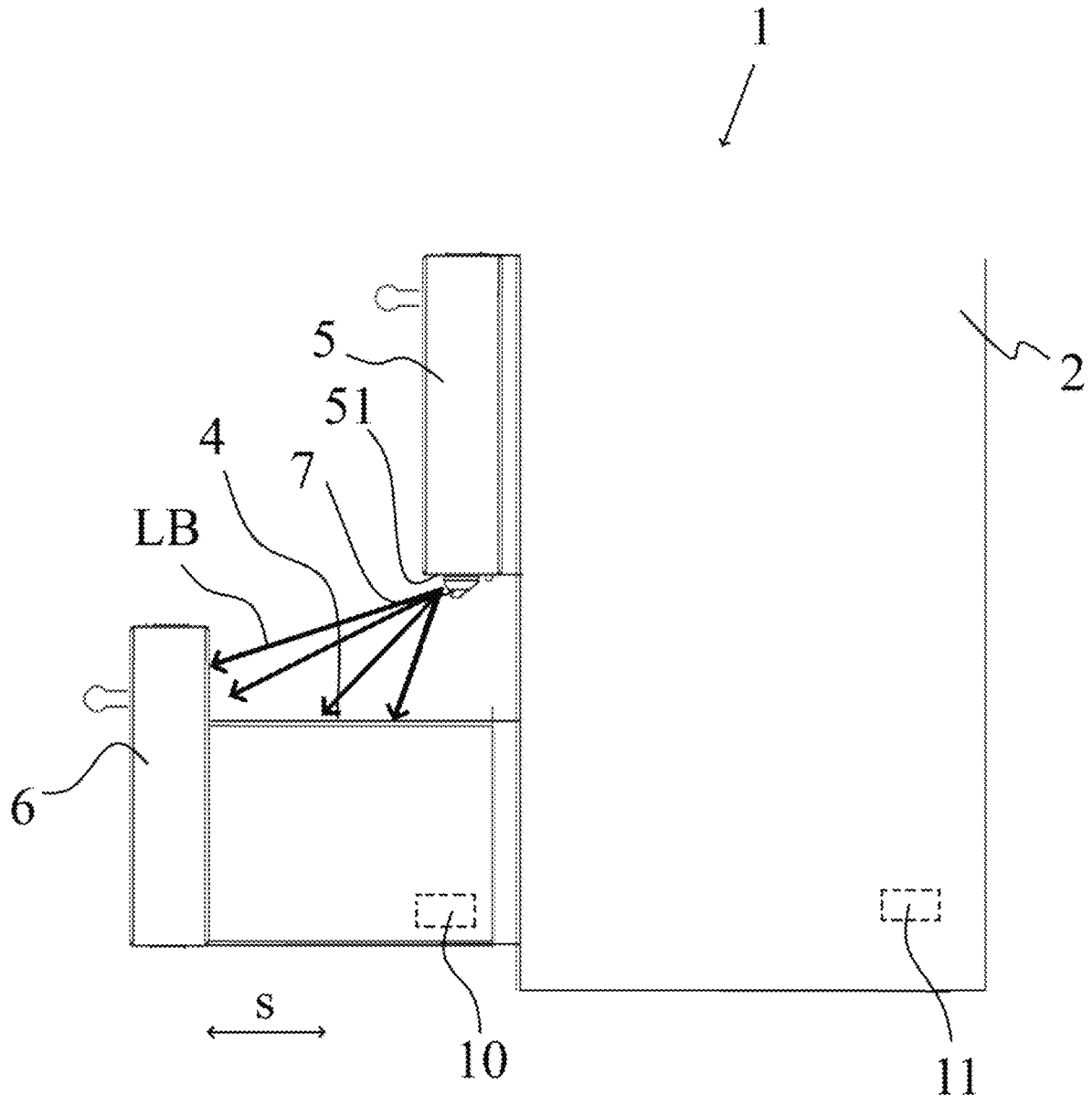
FIG. 3 is an another side view of the household refrigeration appliance where the first and second storage chambers can be seen.

Referring to FIG. 1, the exemplary household refrigeration appliance (1) is a cooling appliance, particularly a refrigerator. The household refrigeration appliance (1) comprises a heat-insulating main body (2) having an outer wall facing outside. The main body (2) comprises a cabinet surrounding a first storage chamber (3) for storing foodstuffs and a second storage chamber (4) for storing foodstuffs, provided under the first storage chamber (3). The storage chambers (3, 4) are separated from one another. At least one first drawer-type door (5) is configured to open or close first storage chamber (3). At least one second drawer-type door (6) is configured to open or close the second storage chamber (4). The drawer-type doors (5, 6) can be opened by pulling the drawer-type doors (5, 6) in a sliding direction(s) independently from each other. Moreover, the drawer-type doors (5, 6) can be opened by pushing the drawer-type doors (5, 6) in the sliding direction(s) independently from each other. A support mechanism (not shown) is connected between the drawer-type doors (5, 6) and the main body (2) so that the drawer-type doors (5, 6) are movably connected to the main body (2). With reference to FIG. 2 and FIG. 3, there is a light unit (7) provided at a lower wall (51) of the first drawer-type door (5) facing the second storage chamber (4) so as to direct the light beams (LB) towards the second storage chamber (4), when the second drawer-type door (6) is in an open position in which the second storage chamber (4) is accessible from outside. A first sensing unit (10) is provided on a portion of the second drawer-type door (6) and a second sensing unit (11) is provided on the main body (2). The sensing units (10, 11) are configured to detect a position of the second drawer-type door (6) provided with the second storage chamber (4) in order to activate or deactivate the light unit (7) with regards to the position of the second storage chamber (4). In more details, when the first sensing unit (10) is in a position corresponding to the second sensing unit (11), this means that the second drawer-type door (6) is at a closed position in which the second storage chamber (4) is completely inside the cabinet of the main body (2) and can not be accessible from outside. When the first sensing unit (10) is in a position not corresponding to the second sensing unit (11), this means that the second drawer-type door (6) is at the open position in which the second storage chamber (4) can at least partially be outside the cabinet of the main body (2) and can be accessible from outside.

Figure 4:
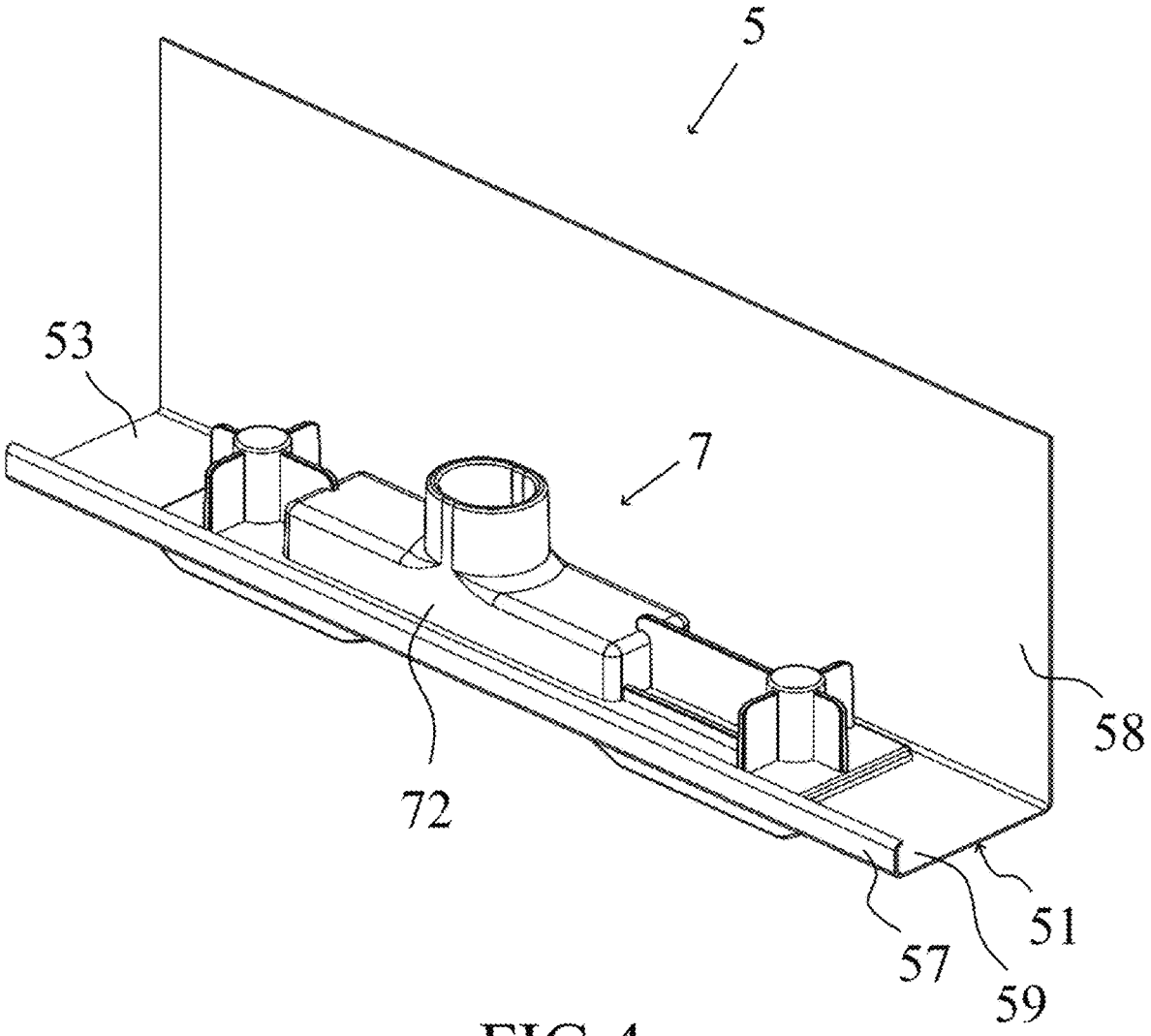
FIG. 4 is a perspective view of the first drawer-type door where the light unit is provided.
Figure 5:
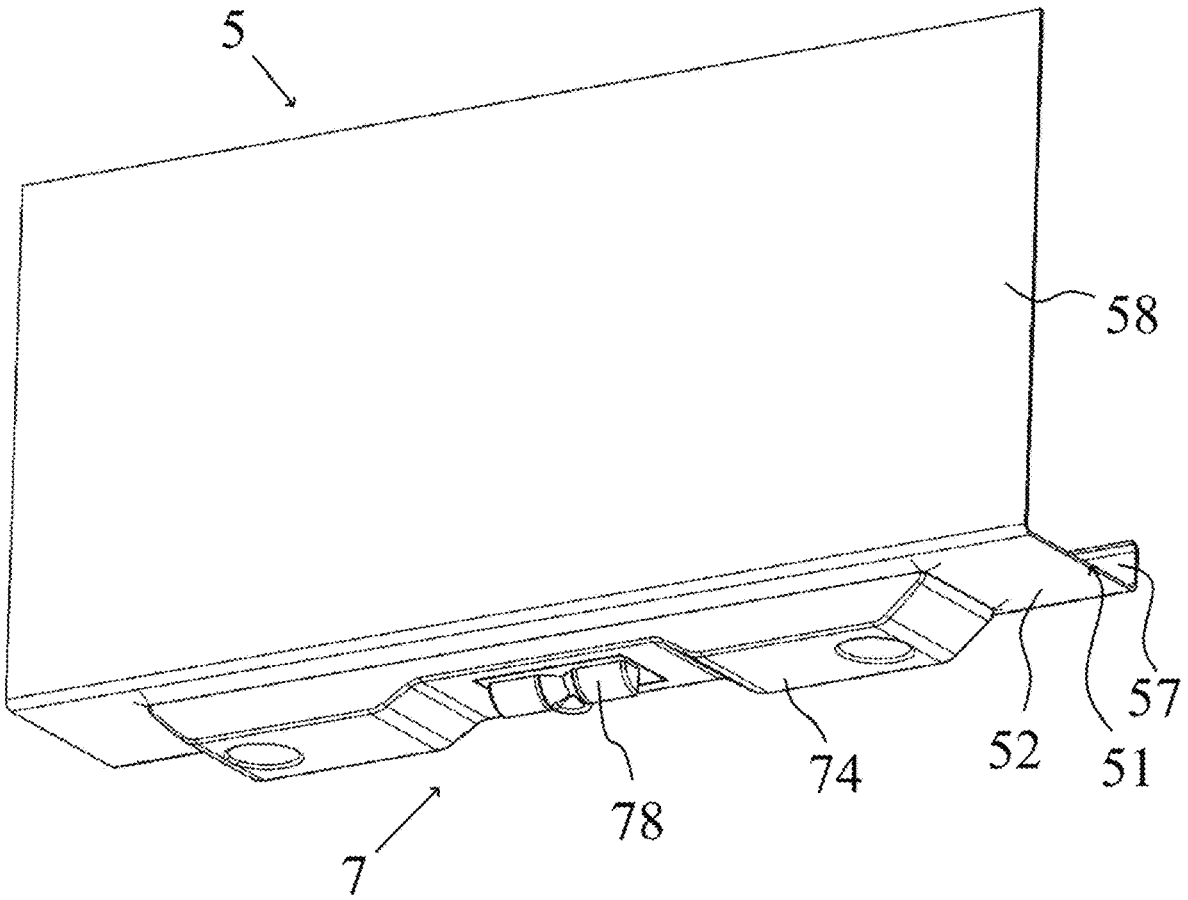
FIG. 5 is an another perspective view of the first drawer-type door where the light unit is provided.
Figure 6:
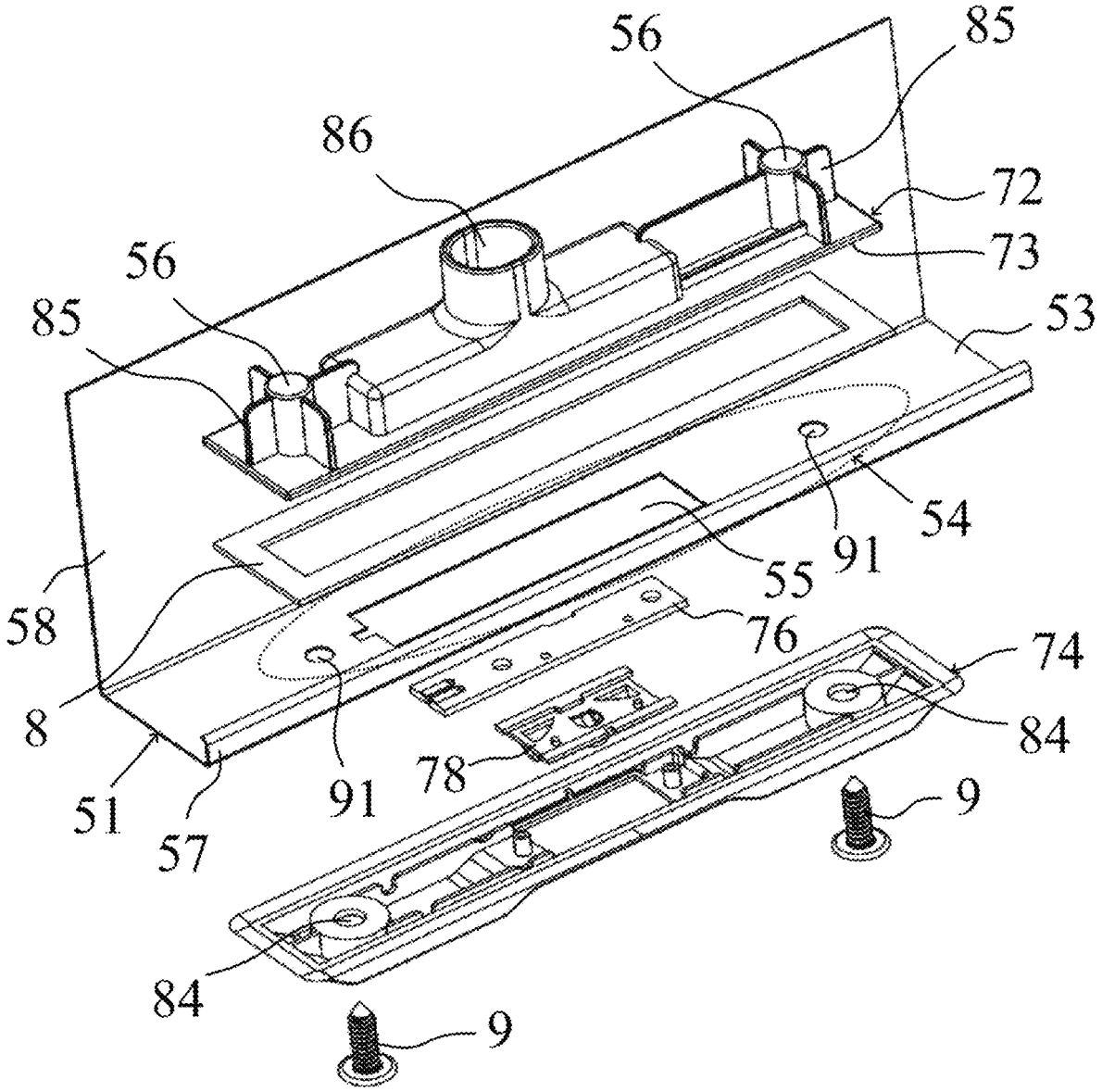
FIG. 6 is an exploded view of the first drawer-type door where the light unit is provided.

With reference to FIGS. 4 and 5, the first drawer-type door (5) comprises an outer wall (58) facing outside and an inner wall (57) spaced apart from the outer wall (58). The lower wall (51) is provided between the inner wall (57) and the outer wall (58) so as to extend perpendicular to the inner wall (57) and the outer wall (58). One of the outer wall (58) and the inner wall (57) can be shorter than the other. One of the wall shorter than the other can be covered with an additional sheet metal part during the mounting process of the first drawer-type door (5). A door gap (59) is provided between said walls (57, 58). An insulation material (not shown) fills said door gap (59) in a foaming process of the first drawer-type door (5). Preferably, the inner wall (57), the outer wall (58) and the lower wall (51) are made from a sheet metal. In a possible embodiment of the invention, the light unit (7) comprises a light module (71) provided on a first surface (52) of the lower wall (51) facing outside. There is a reinforcement part (72) provided on a second surface (53) of the lower wall (51) facing inside of the first drawer-type door (5). With reference to FIG. 6, both the light module (71) and the reinforcement part (72) are provided at a connection region (54) of the lower wall (51) where a connection opening (55) through which one or more connection cables of the light unit (7) pass, is provided. Thus, the light module (71) can be mounted to the lower wall (51) from outside of the door easily. Similarly, the light module (71) can be demounted from the lower wall (51) from outside of the door easily. The connection region (54) is provided at a middle portion of the lower wall (51) extending along a width direction of the first drawer-type door (5). On the other hand, as can be seen in FIG. 2, the reinforcement part (72) is configured as a hollow-shaped box through which the connection cables of the light unit (7) passes. Also the reinforcement part (72) is shaped and sized so as to cover the connection opening (55). The reinforcement part (72) has a connection surface (73) extending parallel to the second surface (53). In more details, the reinforcement part (72) has a plate having the connection surface (73) extending parallel to the second surface (53). An adhesive member (8) is provided between the reinforcement part (72) and the second surface (53). Thus, the reinforcement part (72) connects to the second surface (53) of the lower wall (51).

On the other hand, the light module (71) mainly comprises three parts: a module housing (74), a diffusing member (78) and a circuit board (76) configured with a light source (75). The light module (71) can be connected to the first surface (52) by at least one of adhesive member or connection element. A further adhesive member can be provided between the light module (71) and the first surface (52). In a possible embodiment of the invention, the light module (71) and the reinforcement part (72) are configured so as to connect each other with one or more connection element (9) from outside of the first drawer-type door (5). The module housing (74) is the part of the light module (71) that can directly be seen outside. Said module housing (74) has one or more hollow connection protrusions (84) through which the connection element (9) passes, and the reinforcement part (72) has one or more hollow module connection protrusions (56) in which the respective connection element (9) attaches, corresponding to the hollow connection protrusions (84). The lower wall (51) also has one or more connection holes of the lower wall (91) corresponding the respective hollow connection protrusions (84) and the hollow module connection protrusions (56). Each of the connection elements (9) pass through the respective hollow connection protrusions (84) and connection holes of the lower wall (91) and attaches to the hollow module connection protrusions (56). Thus, the light module (71) connects both the reinforcement part (72) and the lower wall (51). Here, the connection element (9) can be a screw. Furthermore, the hollow connection protrusions (84) has a step portion (not shown) whereon the head portion of the respective screw abuts, when the light module (71) screwed to the reinforcement part (72). When the light module (71) screwed to the reinforcement part (72), the head portion of the screw is being completely inside the hollow connection protrusions (84). Thus, the screws are provided as invisible from outside so as not to effect aesthetic appearance of the light unit (7). On the other hand, in order to increase the endurance of the hollow module connection protrusions (56), one or more reinforcement walls (85) are formed around periphery of the hollow module connection protrusions (56). Preferably, the reinforcement walls (85) are provided so as to be radially distributed around periphery of the hollow module connection protrusions (56). As can be seen in FIG. 6, the reinforcement part (72) comprises an entrance opening (86) where the connection cables of the light unit (7) enters to the reinforcement part (72) configured as a hollow-shaped box. Before the foaming process of the first drawer-type door (5), the connection cables are folded inside the reinforcement part (72). Thus, the box-shaped reinforcement part (72) protects the connection cables during the foaming process of the first drawer-type door (5). Said reinforcement part (72) can be in an essentially hollow T-shaped cross-section which helps to fold the connection cables.

Figure 7:
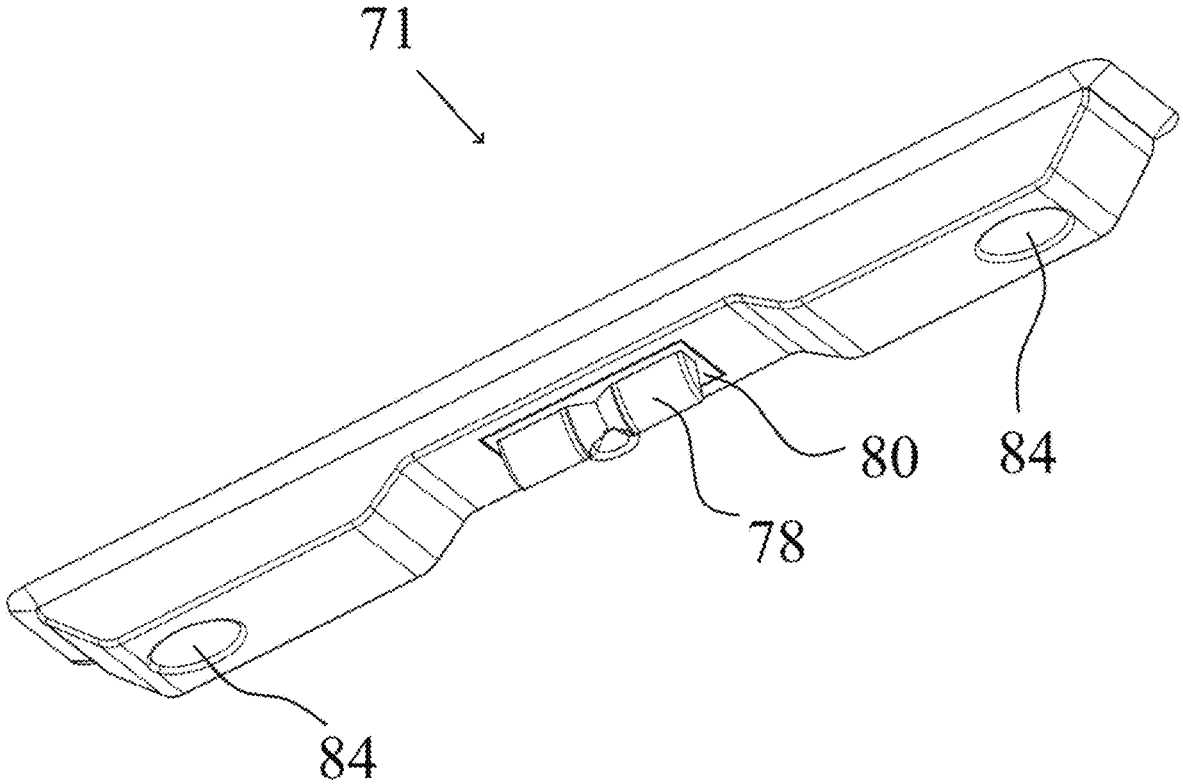
FIG. 7 is a perspective view of the light module.
Figure 8:
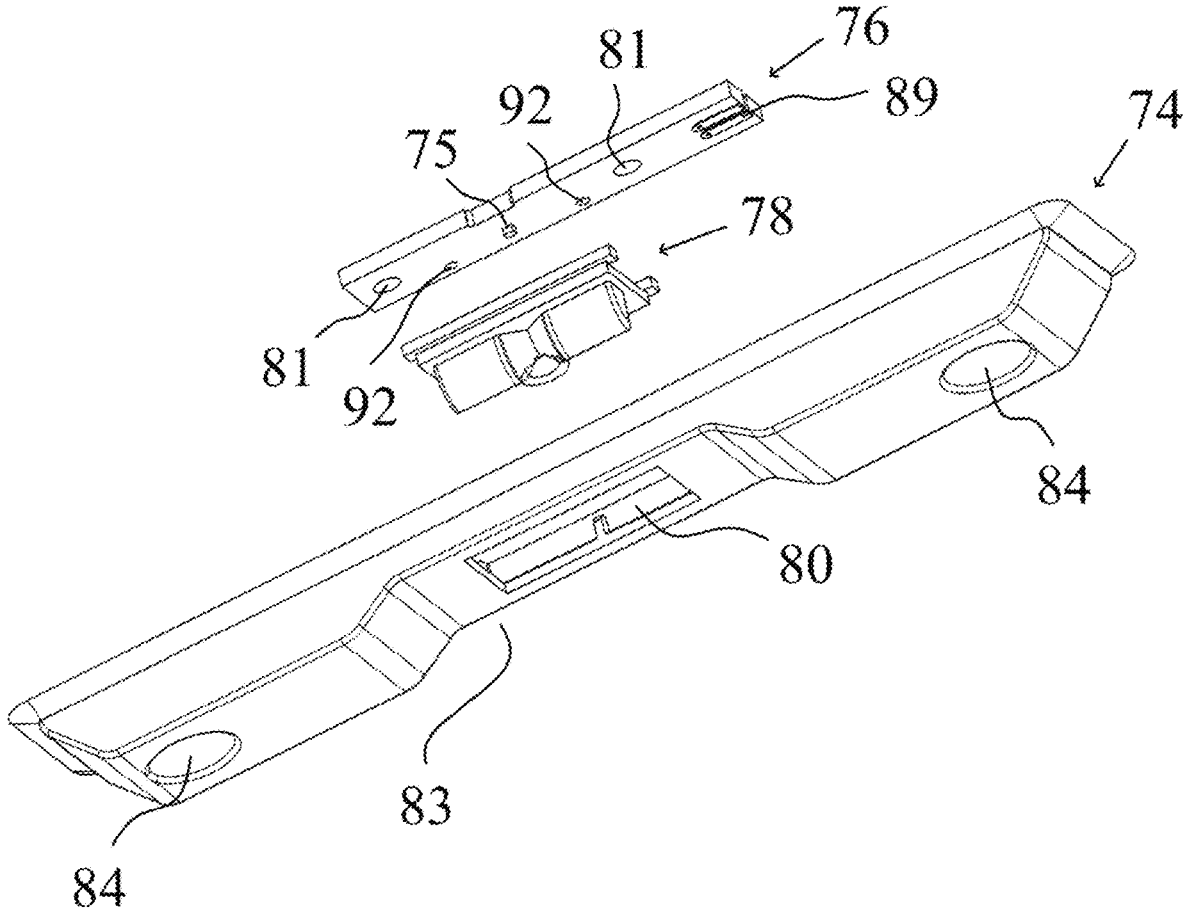
FIG. 8 is an exploded view of the light module.
Figure 9:
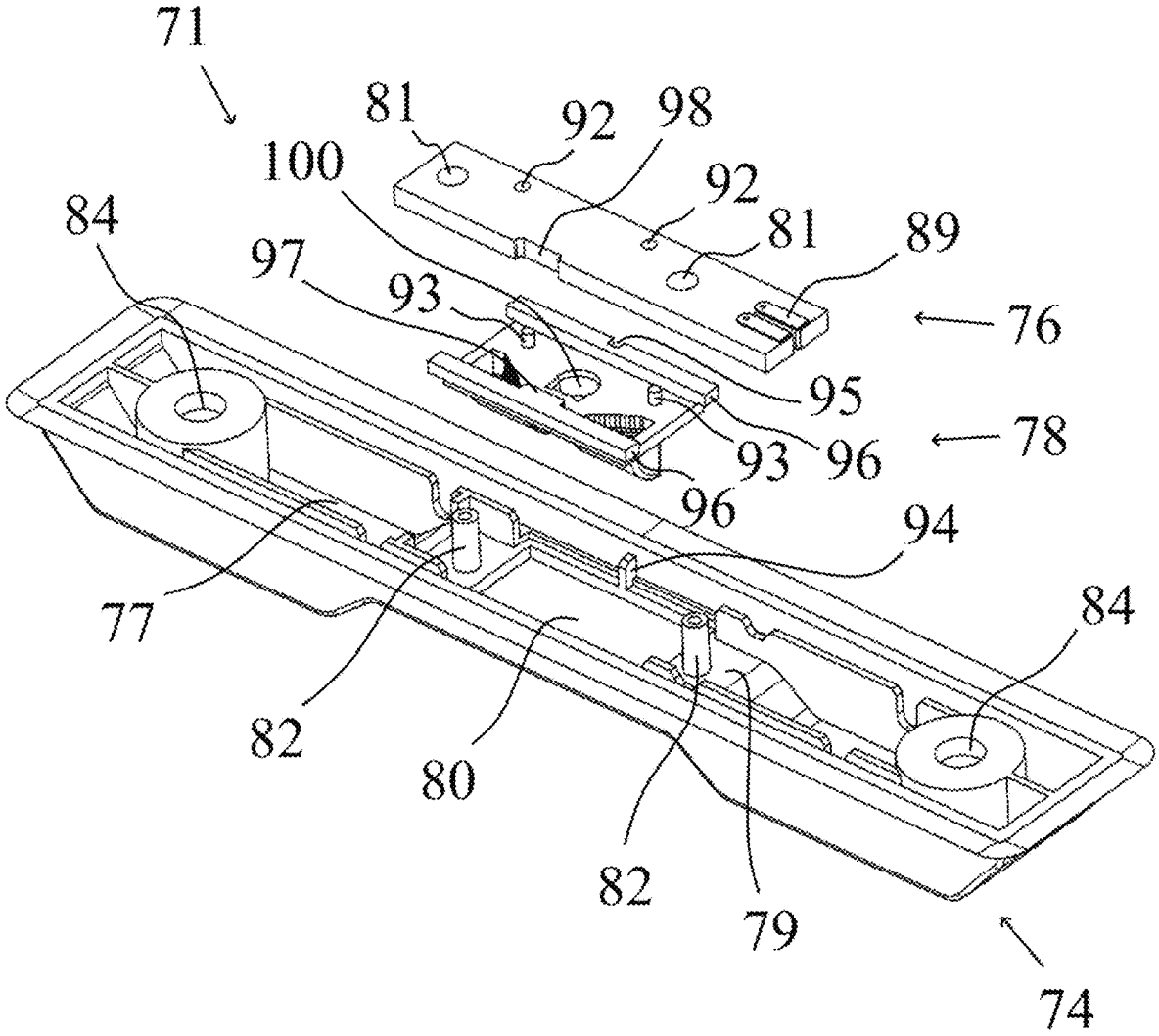
FIG. 9 is an another exploded view of the light module.
Figure 11:
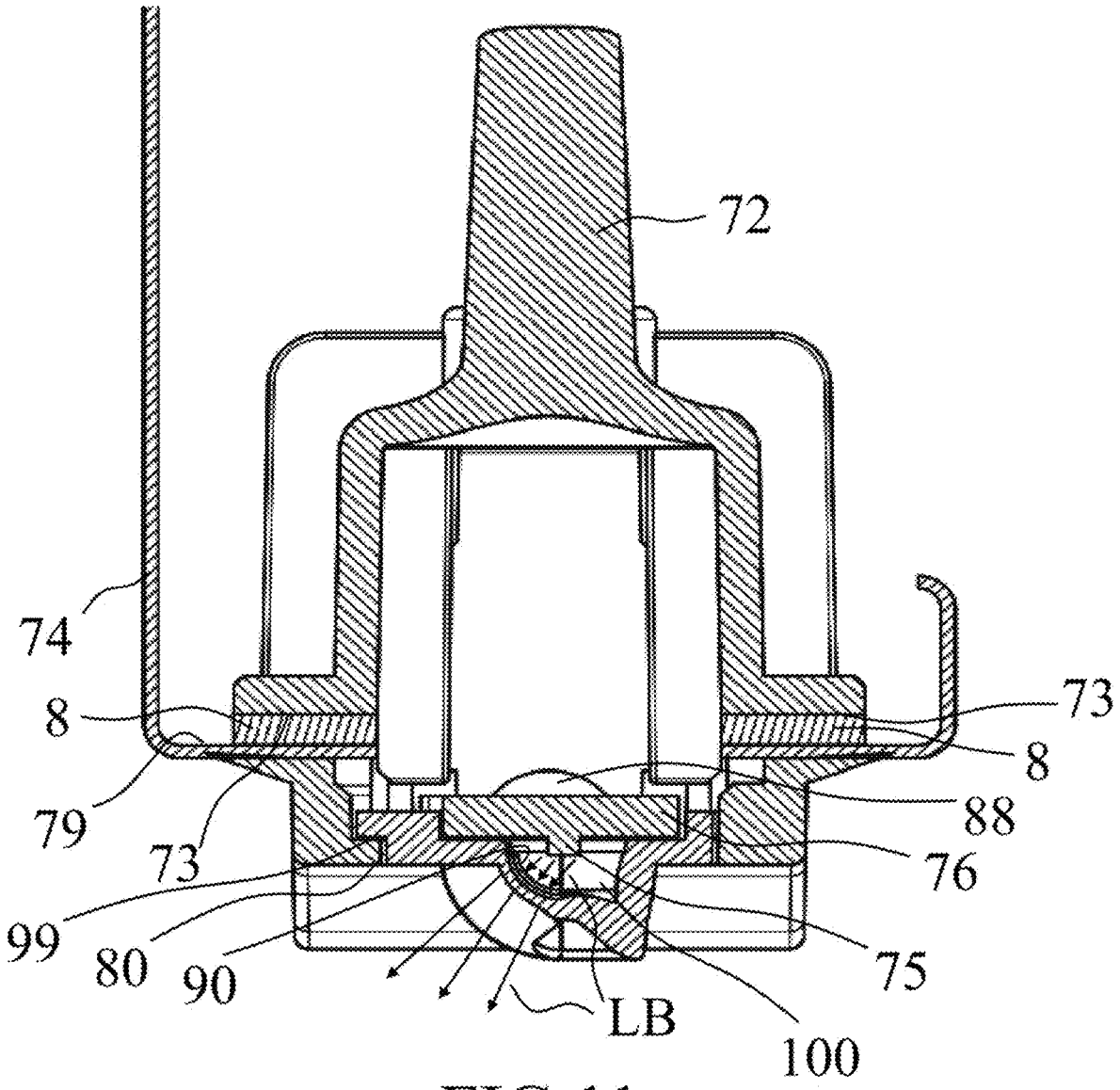
FIG. 11 is a cross-sectional view of first drawer-type door where the light unit is provided with widening section of the first connection protrusion.

With reference to FIG. 7 to 9, the circuit board (76) configured with the light source (75) is provided on the module housing (74). The light source (75) is provided on a side of the circuit board (76), facing the module housing (74). On the other hand, the circuit board (76) has an electrical connection portion (89) where an end of the connection cable passing through the reinforcement part (72) and the connection opening (55), connects. Said end of the connection cable can be provided with a connection socket (not shown). Thus, the electrical power is fed to the circuit board (76) provided with the light source (75). In a possible embodiment of the invention, a base opening (80) is provided on the module housing (74) corresponding to the diffusing member (78). The module housing (74) is configured to have a deepening section (83) on a side facing the outside where the base opening (80) is provided. The diffusing member (78) diffuses the light beams generated by the light source (75) towards the second storage chamber (4) in the open position of the second drawer-type door (6). In a possible embodiment, a first side of the module housing (74) facing the lower wall (51), is configured as a receiving groove (77) for receiving the circuit board (76) configured with the light source (75) and the diffusing member (78). As can be seen in FIG. 11, the diffusing member (78) has a seating surface (99) that seats to a base (79) module housing (74) at a region where the base opening (80) is provided. The diffusing member (78) seats onto the module housing (74) in such a way that the diffusing member (78) at least partially covers the base opening (80). When the diffusing member (78) seats onto the module housing (74), at least a part of the diffusing member (78) pass through the base opening (80). There is a centering protrusion (94) provided on the base (79) of the module housing (74). A centering recess (95) is provided on the diffusing member (78) correspondingly. When the diffusing member (78) seats onto the module housing (74), the centering protrusion (94) is being received by the centering recess (95). This helps to position the diffusing member (78) onto the module housing (74) easily. One or more second connection protrusions (93) are provided on a side of the diffusing member (78) facing the circuit board (76). Moreover, two mutual protruding walls (96) are provided on opposite edges of the diffusing member (78). The mutual protruding walls (96) extend along a width of the diffusing member (78). There is at least one connection tab (97) on a side of the diffusing member (78) opposite to the side where the centering recess (95) is provided. Furthermore, the diffusing member (78) has a light source receiving groove (100) corresponding the light source (75). The light source receiving groove (100) is configured at the center of the diffusing member (78). When the circuit board (76) seat onto the diffusing member (78), a tab receiving recess (98) provided on the circuit board (76) is being received by the connection tab (97). This helps to position the circuit board (76) onto the diffusing member (78) easily. Furthermore, when the circuit board (76) seat onto the diffusing member (78), each of the second connection protrusions (93) pass through the respective second connection holes (92) of the circuit board (76). Thus, the movements of the circuit board (76) which seats onto the area provided between the mutual protruding walls (96), is prevented in both left-right direction and the front-rear direction. The second connection protrusions (93) can have a cylindrical shape and the corresponding second connection holes (92) can have a circular shape. The circuit board (76) has a width longer than the width of the diffusing member (78). The circuit board (76) comprises one or more first connection holes (81). Correspondingly, there are one or more first connection protrusions (82) provided on the module housing (74). In a possible embodiment, the circuit board (76) comprises two first connection holes (81) spaced apart from each other, and two first connection protrusions (82) are provided on the module housing (74), corresponding to the first connection holes (81). The first connection holes (81) are provided so as to be outside of a region that seat onto the diffusing member (78) between the mutual protruding walls (96). When the circuit board (76) seat onto the diffusing member (78), each of the first connection protrusions (82) pass through the respective first connection holes (81). The first connection protrusions (82) can have a cylindrical shape and the corresponding first connection holes (81) can have a circular shape. The width of the first connection protrusions (82) and the first connection holes (81) can be greater than the width of the second connection protrusions (93) and the second connection holes (92).

Figure 10:
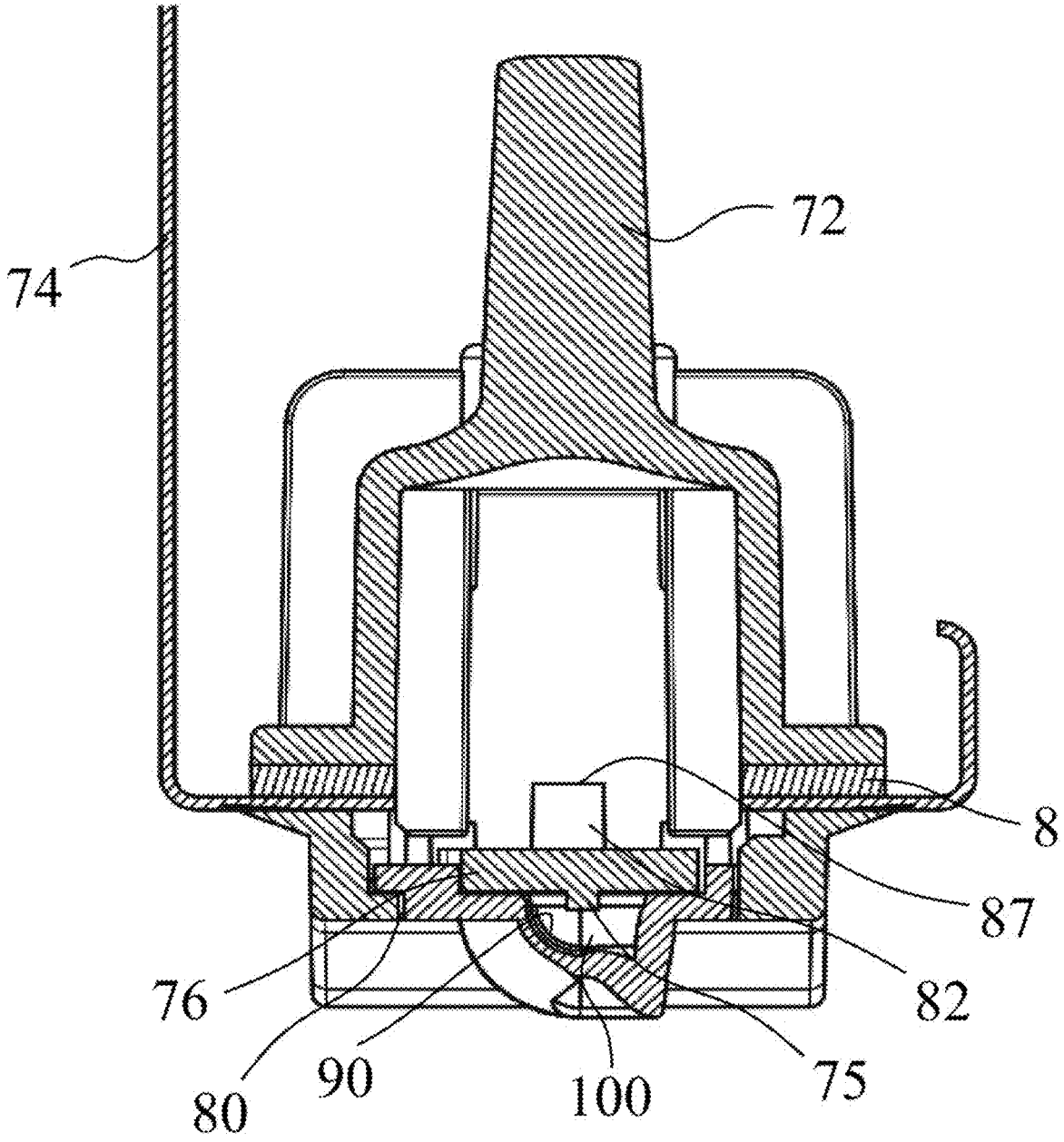
FIG. 10 is a cross-sectional view of first drawer-type door where the light unit is provided without widening section of the first connection protrusion.

With reference to FIGS. 9 and 10, when the diffusing member (78) and the circuit board (76) attached to the module housing (74), the light source (75) corresponds to the light source receiving groove (100) of the diffusing member (78). There is a diffusing portion (90) is provided inside the light source receiving groove (100). Said diffusing portion (90) has an essentially curved shape. As can be seen in FIGS. 3 and 11, the light source (75) directs the light beams towards the diffusing portion (90) and the diffusing portion (90) directs the light beams (LB) towards the respective second storage chamber (4). The diffusing portion (90) has a purpose to diffuse the light beams (LB) generated by the light source (75), towards the second storage chamber (4) and to prevent dazzling of the user.

In the invention, the module housing (74) is made from a plastic-based material. On the other hand, as can be seen in FIG. 10, the first connection protrusions (82) of the module housing (74) has a free end (87) away from the base (79) of the module housing (74). FIG. 10 illustrates the cross-sectional view one step before the completion of the mounting process of the light module (71). FIG. 11 illustrates the cross-sectional view after the completion of the mounting process of the light module (71). As can be seen in FIG. 11, the free end (87) of the connection protrusions (82) is formed so as to provide a widening section (88). In more details, the free end (87) is formed with a melting process. The widening section (88) has a width dimension greater than the width dimension of the first connection holes (81). The widening section (88) can be in a domed shape. Thus, the circuit board (76) is fixed between the widening section (88) and the diffusing member (78) with such a sandwich-like connection arrangement. With this arrangement, the vertical movements of the circuit board (76) and the diffusing member (78) are prevented.

In a possible embodiment of the invention, the household refrigeration appliance (1) comprises two first drawer-type doors (5) configured to open or close the first storage chamber (3) and two second drawer-type doors (6) configured to open or close the second storage chamber (4) and provided under the respective first drawer-type doors (5). Each of the first drawer-type doors (5) can have light units (7) independent from each other for directing the light beams (LB) towards the corresponding second storage chambers (4).

REFERENCE LIST

1. Household refrigeration appliance
2. Main body
3. First storage chamber 4. Second storage chamber
5. First drawer-type door
  51. Lower wall
  52. First surface
  53. Second surface
  54. Connection region
  55. Connection opening
  56. Hollow module connection protrusions
  57. Inner wall
  58. Outer wall
  59. Door gap
6. Second drawer-type door
7. Light unit
  71. Light module
  72. Reinforcement part
  73. Connection surface
  74. Module housing
  75. Light source
  76. Circuit board
  77. Receiving groove
  78. Diffusing member
  79. Base
  80. Base opening
  81. First connection hole
  82. First connection protrusion
  83. Deepening section
  84. Hollow connection protrusion
  85. Reinforcement walls
  86. Entrance opening
  87. Free end
  88. Widening section
  89. Electrical connection portion
  90. Diffusing portion
  91. Connection hole of the lower wall
  92. Second connection hole
  93. Second connection protrusion
  94. Centering protrusion
  95. Centering recess
  96. Protruding walls
  97. Connection tab
  98. Tab receiving recess
  99. Seating surface
  100. Light source receiving groove
8. Adhesive member
9. Connection element
10. First sensing unit
11. Second sensing unit
LB. Light beams
s. Sliding direction

The invention claimed is:

1. A household refrigeration appliance, comprising:
a main body formed with:
  a first storage chamber for storing foodstuffs; and
  a second storage chamber for storing foodstuffs below said first storage chamber;
at least one first drawer door configured to selectively open or close said first storage chamber;
at least one second drawer door configured to selectively open or close said second storage chamber; and
a light unit disposed at a lower wall of said first drawer door facing said second storage chamber so as to direct light towards said second storage chamber, when said second drawer door is in an open position and in which said second storage chamber is accessible from outside;
said lower wall of said first drawer door having a first surface facing outward, a second surface facing inward, and a connection region formed with a connection opening through which one or more connection cables of said light unit pass;
said light unit having a light module disposed on said outward-facing first surface of said lower wall and a reinforcement part disposed on said inward-facing second surface of said lower wall of said first drawer door; and
said light module and said reinforcement part being disposed at said connection region of said lower wall with the connection opening for the one or more connection cables of said light unit.

2. The household refrigeration appliance according to claim 1, wherein said connection region is disposed at a center portion of said lower wall extending along a width direction of said first drawer door.

3. The household refrigeration appliance according to claim 1, wherein said light module comprises a module housing and a circuit board with a light source, provided on said module housing.

4. The household refrigeration appliance according to claim 3, wherein a first side of the module housing facing said lower wall is formed with a receiving groove for receiving said circuit board configured with said light source.

5. The household refrigeration appliance according to claim 3, wherein said module housing is formed with a base opening corresponding to a diffusing member configured to diffuse light beams generated by said light source towards said second storage chamber in the open position thereof.

6. The household refrigeration appliance according to claim 3, wherein said circuit board is formed with one or more first connection holes and said module housing is formed with one or more first connection protrusions, corresponding to said first connection holes.

7. The household refrigeration appliance according to claim 6, which comprises a diffusing member having one or more second connection protrusions, said circuit board is formed with one or more second connection holes, and each of said second connection protrusions passes through a respective said second connection hole when said circuit board is seated on said diffusing member.

8. The household refrigeration appliance according to claim 7, wherein a free end of said first connection protrusions has a widening section formed after said circuit board and said diffusing member placed on said module housing, with said connection protrusions passing through respective said first connection holes and then limiting a vertical movement of said circuit board and said diffusing member.

9. The household refrigeration appliance according to claim 1, wherein said light module and said reinforcement part are configured to connect each other with one or more connection element from outside of said first drawer door.

10. The household refrigeration appliance according to claim 9, wherein said module housing has one or more hollow connection protrusions through which said connection element passes, and wherein said reinforcement part has one or more hollow module connection protrusions in which the respective said connection element attaches, corresponding to said hollow connection protrusions.

11. The household refrigeration appliance according to claim 1, wherein said reinforcement part is a hollow-shaped box through which the one or more connection cables of said light unit pass.

12. The household refrigeration appliance according to claim 11, wherein said reinforcement part is formed with an entrance opening where the one or more connection cables of said light unit enter into said reinforcement part that is formed as a hollow-shaped box.

13. The household refrigeration appliance according to claim 1, which comprises an adhesive member on at least one of the regions provided between said reinforcement part and said second surface, or between said light module and said first surface.

14. The household refrigeration appliance according to claim 1, wherein said at least one first drawer door is one of two first drawer doors for opening and closing said first storage chamber, and wherein each of said first drawer doors has a respective light unit independent from another said light unit for directing the light beams towards the respective second storage chambers.

15. The household refrigeration appliance according to claim 1, which comprises a first sensing unit disposed on a portion of said at least one second drawer door and a second sensing unit disposed on said main body, and wherein said first and second sensing units are configured to detect a position of said at least one second drawer door in order to selectively activate or deactivate said light unit with reference to a position of said second storage chamber.

* * * * *